US006098905A

United States Patent [19]

Salem et al.

[11] Patent Number: 6,098,905

[45] Date of Patent: Aug. 8, 2000

[54] METHOD FOR PRODUCING AN ATTA FLOUR

[75] Inventors: Ali Salem; Sarath K. Katta; Sambasiva R. Chigurupati, all of Omaha, Nebr.

[73] Assignee: ConAgra, Inc., Omaha, Nebr.

[21] Appl. No.: 09/132,284

[22] Filed: Aug. 11, 1998

[51] Int. Cl.[7] ..... B02C 9/04

[52] U.S. Cl. ..... 241/3

[58] Field of Search ..... 241/3, 7, 79, 227

[56] References Cited

U.S. PATENT DOCUMENTS

| | | | |
|---|---|---|---|
| 3,979,375 | 9/1976 | Rao et al. | 260/112 G |
| 4,094,700 | 6/1978 | Rennes et al. | 127/24 |
| 5,114,079 | 5/1992 | Curran | 241/3 |
| 5,165,608 | 11/1992 | Baltensperger et al. | 241/9 |
| 5,192,028 | 3/1993 | Curran | 241/3 |
| 5,373,997 | 12/1994 | Baltensperger et al. | 241/79 |
| 5,544,823 | 8/1996 | Baltensperger et al. | 241/79 |
| 5,678,777 | 10/1997 | Satake et al. | 241/227 |

*Primary Examiner*—Joseph J. Hail, III
*Assistant Examiner*—Dermott J. Cooke
*Attorney, Agent, or Firm*—Lathrop & Gage L.C.

[57] ABSTRACT

The present invention relates to a method for producing an atta flour, which is typically used to produce Asian breads such as chapati and roti. The atta flour method includes passing an amount of wheat through a device designed to crack the wheat so as to produce an amount of cracked wheat, followed by passing the cracked wheat through at least two smooth rolls designed to grind the cracked wheat into flour, with the smooth roll importantly grinding the wheat to a smaller particle size and shearing the wheat to cause starch damage in the finished atta flour. The atta flour will have an amount of starch damage equal to between about 13% and about 18% and an amount of ash equal to at least 1%.

8 Claims, 1 Drawing Sheet

METHOD FOR PRODUCING AN ATTA FLOUR

CROSS REFERENCE TO RELATED APPLICATION

This application is a continuation of co-pending application Ser. No. 09/132,284 filed Aug. 11, 1998, the contents of which are incorporated herein by reference.

FIELD OF THE INVENTION

The present invention relates to a method for producing an atta flour, which is suitable for making various types of Asian breads such as chapati and roti.

BACKGROUND OF THE INVENTION

Atta flour is typically used in the countries of India, Pakistan, Bangladesh, and Indonesia and is the flour of choice for making food products such as chapati, naan, parota, roli, and roti breads. A specific flour is required to make such breads because the flour must have high a percentage of starch damage and a fine granulation so that the dough absorbs more water and the dough formed from the flour is sticky. Also, when the atta flour is formed into a bread it is desired for the bread to have a particular color, with the color resultant primarily from the amount of ash found in the flour. Thus, the atta flour has specific characteristics that are required for producing an atta flour that is commercially viable and suitable for making the before mentioned breads, namely, high starch damage and an amount of ash greater than 1%.

Traditionally, atta flour is made in small villages throughout the countries mentioned above, with the wheat used to form the flour ground by hand in a stone mill. Grinding the wheat in a stone mill produces a flour that has high levels of starch damage, and a desirable color and granulation. Starch damage results from the attrition of the starch granules in the stone mill. The harsh physical treatment by stone milling causes the starch granules to rupture, crack, and cut, as well as, other types of damage to the starch granules. The portion of the starch granule primarily damaged is the large lenticular granules, the starch granule also includes the small spherical granules but these are not typically damaged. It is further known that the proportion and percentage of starch damage increases with the severity of grinding. While, stone milling produces sufficient starch damage, most stone milling methods unfortunately are done by hand and are inefficient. Mechanically driven stone mills can be developed, but few large stone mills which are mechanically driven produce an atta flour with characteristics similar to an atta flour produced by a hand stone mill. Further, most mechanical stone mills have a small capacity, this means the stone mills are inefficient. Because hand stone mills are inefficient and most commercial stone mills generally do not produce an acceptable atta flour and are inefficient, it is desired to find a method for producing the atta flour on a commercial scale. The atta flour has tremendous commercial potential because the atta flour is consumed by a large portion of the world's population. In particular, increased industrialization and urbanization of India has increased the demand for convenience food and high volume production of atta flour. It is important to find a process where a large scale method can be used to produce atta flour with high starch damage. It is further desired to be able to produce the atta flour on a commercial basis, as opposed to producing the atta flour by hand methods or small capacity stone mills.

Most known previous methods developed for producing an atta flour on a commercial scale have proven unsuccessful. Some of the known atta flours produced according to other commercial processes have suffered from insufficient starch damage in the flour and/or an inadequate color. It is desired to have a commercial process for producing an atta flour that does not involve a stone grinder to mill the wheat.

Furthermore, most known commercial flours, in particular non-atta flours, do not have a level of starch damage equal to about 15%, in fact most commercial whole wheat flours have an amount of starch damage equal to about 9% or less. As such, most known flours produced by a roller mill or similar device do not have characteristics similar to the atta flour. It is preferred to not have high starch damage in whole wheat flours as this will make the dough formed from the flour too sticky, and the bread crumb dough will be gummy.

It is desired to have an efficient industrial process for producing an atta flour having sufficient starch damage, so that breads indigenous to India, Pakistan, Bangladesh, and Indonesia can be readily produced from commercially available flour. Such a process would preferably eliminate the need for traditional hand formation methods, such as stone milling, as well as, commercial processes involving stone milling.

SUMMARY OF THE INVENTION

The present invention relates to a method for producing an atta flour, wherein said method includes passing an amount of wheat through a device designed to crack the wheat, preferably a corrugated roll, and then passing the cracked wheat through at least two smooth rolls, with the corrugated roll and smooth roll comprised of two separate cylindrical individual rolls. The separate cylindrical individual rolls preferably rotate at different speeds to create a speed differential. The smooth roll is a device comprised of two separate cylindrical rolls each having a smooth surface, the two cylindrical rolls are placed in close proximity to one another so that when the cracked wheat passes through the space between the two rolls, the wheat is ground to a smaller particle size to form flour. Not only does the smooth roll reduce the particle size of the wheat, but it causes enough shear to the flour to increase starch damage. After passage through at least two smooth rolls an atta flour will be produced which has between about 13% and about 17% starch damage and which preferably has an amount of ash equal to between about 1% and about 2% by weight of the flour. More preferably, the atta flour will have starch damage equal to about 15%. The atta flour is ideally suited for forming Asian breads such as roti and chapati.

In the most preferred method an amount of wheat, similar to Asian wheat, which is considered semi-hard or soft, is passed through a corrugated roll, with such corrugated roll designed to crack the wheat to form an amount of cracked wheat. Instead of a corrugated roll, a hammer or disc mill can be used to grind the wheat. The cracked wheat is then passed through a smooth roll which will grind the wheat to reduce the particle size and shear the wheat to cause starch damage and produce an atta flour. After passage through the two smooth rolls, preferably the atta flour is passed through a smooth roll one more time for further grinding and shearing. Also, as mentioned, both the corrugated and the smooth roll or rolls will each be comprised of two individual cylindrical rolls which will rotate at speeds ranging between about 200 rpms and about 600 rpms. Most importantly, there will preferably be a speed differential between the individual rolls ranging between about 2:1 and about 3:1. Preferably, after production of the atta flour an amount of fines from ground bran are added to the flour to raise the ash content in the flour.

It is important to note that the present method uses a commercial roller mill, which is a smooth roll, as opposed to a stone mill to produce the atta flour. The use of the smooth roll is presently economically efficient and produces an atta flour having sufficient starch damage.

DETAILED DESCRIPTION OF THE INVENTION

Figure 1:
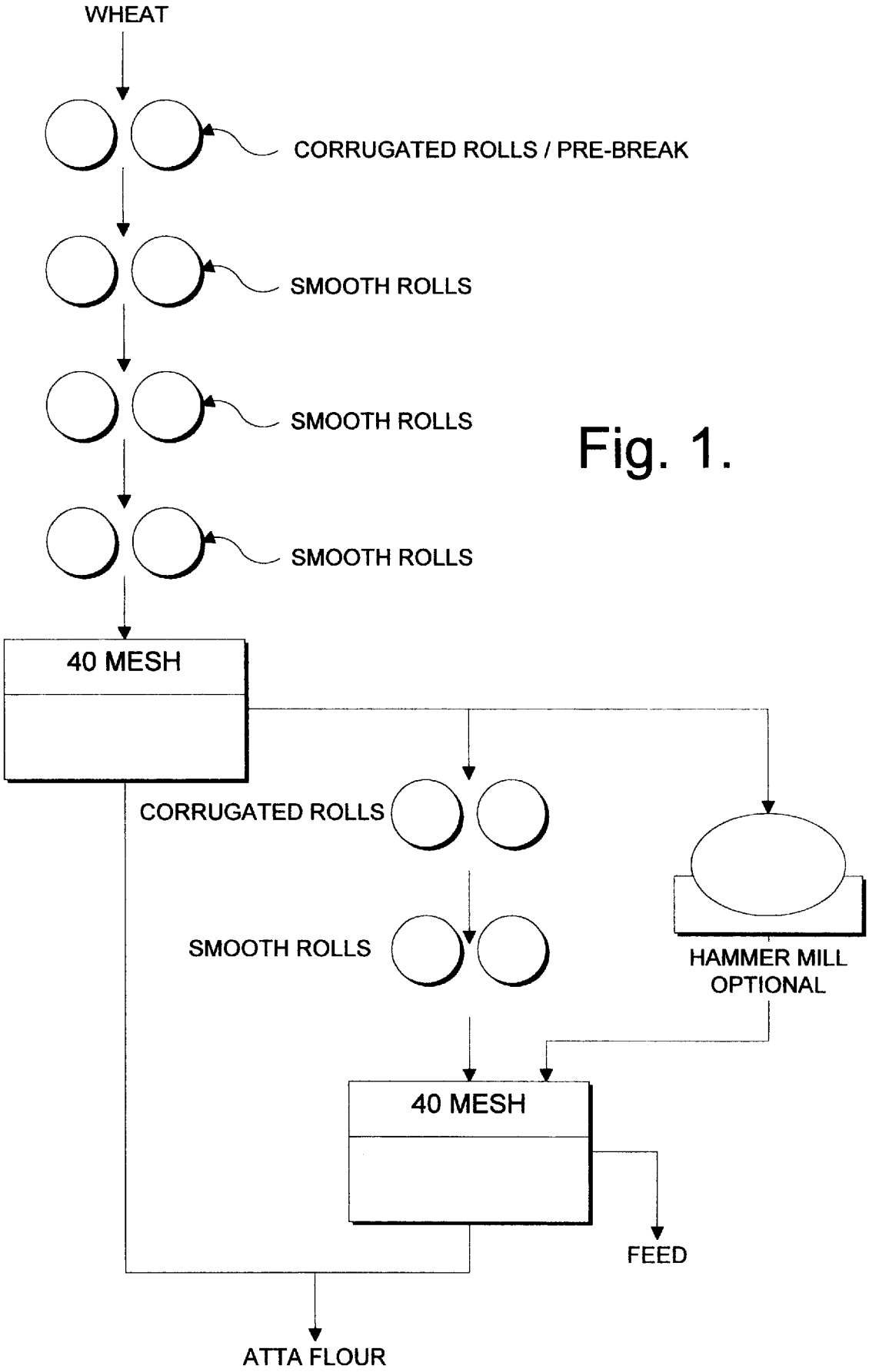
FIG. 1 is a flow diagram showing how the atta flour is preferably produced from an amount of wheat.

The present invention relates to a method for producing an atta flour which is suitable in making chapati, naan, parota, roli, and roti breads. Such breads are typically consumed in the countries of India, Pakistan, Bangladesh, and Indonesia. Importantly, the method produces an atta flour which has a high level of starch damage, which is required in forming such breads, and a desirable amount of ash. The amount of ash in the atta flour influences the color of the bread made from the atta flour and is important to the present invention. It is necessary for the atta flour to have a particular golden color in order for the atta flour, and particularly the bread made from the flour, to be visually appealing to a typical consumer. Specifically, the atta flour has a level of starch damage preferably equal to about 15% and an amount of ash preferably equal to about 1% by weight of the atta flour. If the atta flour does not have an amount of starch damage equal to approximately 15% then it is found that suitable breads mentioned above most likely cannot be formed. In particular, such breads will be hard and unacceptable to consumers.

The method for forming the atta flour involves first selecting an amount of wheat. Generally, any class of wheat can be selected to form the atta flour; however, it is most preferred to select a hard wheat or semi-hard wheat. Hardness relates to how strongly gluten and starch found in the wheat are held together, with the hardness being variety specific and the result of growing conditions. More specifically, hardness relates to the strength of the bond between protein and starch in the wheat. Hard wheat is preferred because the harder the endosperm texture the more starch damage can be produced. Durum wheat is generally the hardest wheat and produces starch damage equal to 10 to 11%, while soft wheat produces an amount of starch damage equal to 3 to 5%. This percentage of starch damage is achieved under normal milling conditions. Durum wheat appears to be the most preferred wheat class used in the present method, as Durum wheat has a hardness equal to about 120, which is a number determined by using a near infrared analyzer. Other wheat classes suitable for use include hard red spring wheat, hard red winter wheat, and soft white wheat. Generally, any class of wheat can be used to form the atta flour of the present method.

The present method is part of a continuous process so that the amount of wheat selected does not matter. Once the particular class of wheat has been selected, an amount of the wheat is cracked. Preferably, the wheat is cracked by passing it through a corrugated roll comprised of a pair of side-by-side cylindrical corrugated rolls designed to break or crack the wheat. In other words, the cylindrical corrugated rolls in the corrugated roll will crack the kernel of the wheat. While the corrugated roll is preferred, any device can be used which cracks the wheat kernel; other such devices include a hammer mill and a disc mill. The two cylindrical corrugated rolls which form the corrugated roll will rotate at a speed ranging between about 200 revolutions per minute (rpms) and 600 rpms. Preferably, one of the cylindrical corrugated rolls will rotate at a speed ranging between about 200 rpms and about 250 rpms, with the other cylindrical corrugated roll rotating at a speed ranging between about 500 rpms and about 600 rpms. Regardless of the speed, it is preferred if there is a speed differential between the cylindrical corrugated rolls equal to between about 2:1 and about 3:1. Also, the cylindrical corrugated rolls will preferably have the closest available gap setting available so that the two rolls are nearly touching. The gap setting is generally 0.075 millimeters (mm) or smaller. Passage through the corrugated roll will form an amount of cracked wheat which is suitable for grinding and forming an amount of the atta flour.

The cracked wheat will then be passed through a smooth roll at least twice. Exposure to the smooth roll is designed to reduce the particle size of the cracked wheat and form an atta flour. Also, the smooth roll should produce enough shear to the wheat so that sufficient starch damage is achieved in the atta flour. Sufficient particle size reduction and shearing of the flour will be dependent in part upon the speed differential in the smooth roll, the speed of the smooth roll, the roll pressure, and the feed rate of the cracked wheat into the roll. The smooth roll is comprised of two separate cylindrical rolls which will have the smallest possible gap setting so that the separate cylindrical rolls are practically touching. Such a gap setting will be equal to about 0.01 mm or smaller. Importantly, the two separate rolls will preferably rotate at different speeds so that a speed differential ranging between about 2:1 and about 3:1 will exist. To achieve the differential, the two separate rolls will rotate at speeds ranging between about 200 rpms and about 600 rpms. More preferably, one of the separate rolls will rotate at a speed ranging between about 200 rpms and about 250 rpms and the other separate roll will rotate at a speed ranging between about 500 rpms and about 600 rpms. Importantly, it has been determined that the faster the speed of each roll the greater the starch damage. The separate roll speed differential is crucial to ensure that sufficient shear of the wheat occurs. Without shearing of the wheat sufficient starch damage will not result. The increased speed differential increases the shear on the wheat which in turn increases the starch damage. Shear is also related to the feed rate through the smooth roll, as a decreased feed rate results in an increased shear of the wheat.

While the wheat can be passed through only two smooth rolls, it is preferred to pass the wheat through the smooth roll step three times. The number of passages through the smooth roll are dependent in part upon wheat hardness. Consequently, after passage through the first smooth roll the flour is passed through a second smooth roll which is also a pair of side-by-side separate cylindrical smooth rolls. Again, the smooth rolls will have the smallest gap setting available, which is preferably 0.01 mm or smaller. The separate rolls will again rotate at a speed ranging between about 200 rpms and about 600 rpms. Preferably, the separate smooth rolls will have a speed differential ranging between about 2:1 and about 3: 1, with one roll having a speed ranging between about 200 rpms and about 250 rpms and the other roll having a speed ranging between about 500 rpms and about 600 rpms. The second smooth roll will further grind the flour to a smaller particle size and cause further shear and consequently increased starch damage.

After passage through the second smooth roll, the flour is then preferably passed through a third smooth roll. The third smooth roll will also be comprised of a pair of side-by-side separate cylindrical smooth rolls. The separate smooth rolls will be the same as discussed above so that the gap setting will be as close as possible, with the gap setting preferably being 0.01 mm or smaller. Again the separate rolls will rotate at a speed ranging between about 200 rpms and about 600 rpms. Preferably, the separate smooth rolls will have a speed differential ranging between about 2:1 and about 3: 1, with one roll having a speed ranging between about 200 rpms and about 250 rpms and the other roll having a speed ranging between about 500 rpms and about 600 rpms. The third smooth roll will further grind the flour to a smaller particle size and cause further shear to the flour. The third passage may be necessary if the wheat used is quite soft. Over grinding for the third time should achieve the desired amount of starch damage in the atta flour. It should also be noted that one smooth roll may be used so long as the wheat is passed through the smooth roll a total of two (2) or three (3) times.

After passage through the smooth rolls, the flour is sifted through a U.S. mesh 40 screen, wherein the flour which passes through the U.S. mesh 40 screen has a sufficient particle size and shear to be used as an atta flour. The coarse ground wheat retained on the U.S. mesh 40 screen can be optionally reground by passing the wheat through the corrugated rolls again or the smooth rolls again or both. Additionally, other methods may be used to grind the coarse ground wheat, such as a hammer mill or disc mill. It is even more preferred to pass the flour through a U.S. mesh 60 screen, as this will result in an atta flour having a finer granulation.

An amount of the fines from the ground bran of the wheat should be mixed with the atta flour. Fines are ground bran from the wheat having a small particle size. The fines appear to contain ash and as such the addition of the fines will influence the color of the atta flour by adding an amount of ash to the atta flour. Enough of the fines should be added so that the atta flour has an amount of ash equal to between about 1% and about 2%.

The atta flour formed according to the present method will have an amount of starch damage ranging between about 13% and about 17%, more preferably the atta flour will have an amount of starch damage equal to about 15%. Also, it is preferred for the atta flour to have an amount of ash equal to between about 1% and about 2% by weight of the atta flour, more preferably an amount of ash equal to about 1.2% by weight of the atta flour will be present in the atta flour. This amount of ash will cause bread formed from the dough made from the present atta flour to have a golden color, which appears to be desired by consumers. It is also preferred if the atta flour has a moisture level equal to between about 8% and about 11% and an amount of protein ranging between about 9% and about 12%.

As mentioned, the atta flour is ideally suited for forming dough for forming various types of Asian breads. The atta flour can have an amount of water added thereto and be used to form doughs which then form chapati, naan, parota, roli, and roti breads.

The following examples are for illustrative purposes only and are not meant to limit the claims in any way.

EXAMPLES

Example 1

Preliminary trials were conducted at Kansas State University in Manhattan, Kansas, where Atta flour samples were prepared and analyzed. Hard red winter wheat (HRW) was used to produce the atta flour.

First, an atta flour sample was prepared wherein the HRW wheat, 5 kg, was initially cracked by passing the wheat through the three successive corrugated rolls of an Allis Chalmers laboratory mill. The corrugated rolls were comprised of two separate cylindrical rolls. Passage through the corrugated rolls involved successive gradual grinding, so that the wheat was ground to a smaller size through each corrugated roll. As such, the gap settings through the breaks in the corrugated rolls were set to open the kernels in the first break, remove the endosperm in the second break, and to remove more endosperm in the third break and separate the endosperm from the bran. The endosperm was then further separated by sifting and ground to a flour by passing the endosperm through a pair of smooth rolls. The smooth rolls were was also made by Allis Chalmers. The roll speed and gap settings were those parameters suggested by the manufacturer. The atta flour, after passage through the smooth roll, had an amount of starch damage equal to about 5%. Passage through one smooth roll was considered an unacceptable procedure because there was only 5% starch damage, this is an insufficient amount of starch damage for an atta flour. Thus, it was concluded that wheat passed once through a roller mill produced an unacceptable atta flour.

Example 2

Next, an atta flour was produced the same as above in Example 1, but after passage through the roller mill or smooth mill the ground wheat was put through a ball mill for 24 hours. The atta flour produced by passage through a roller mill and a ball mill had an amount of starch damage equal to 17.7%. While the atta flour produced according to this process had acceptable starch damage, it was determined that this method was unacceptable because ball milling is not presently economical or available commercially.

Example 3

Tests were conducted by United Milling Systems of Denmark, who conducted a plurality of tests. Seven (7) samples were prepared using different milling procedures including disc milling, flaking roller milling, and combinations of disc and roller milling to produce atta flour samples. The milling procedures were performed on Indian wheat. In the samples analyzed below, the disc milling, roller disc, types A, B, and C columns disclosed the results from passing whole wheat through a disc mill having a different gap settings, so that different granulations of flour were produced. The production of the flour using different gap settings was designed to determine if different granulations resulted in different levels of starch damage. Passage through the disc mill was preceded by passage through a flaking roll. The Maida Roller Mill, listed below, involved passing whole wheat through a roller mill once and did not include further grinding of the bran. The following table shows the analytical results of seven different processes compared to stone ground flour, which is the Gold Seal Atta.

| Sample # ID | 10098 GOLD SEAL ATTA | 11423 DISC MILL | 11424 ROLLER DISC | 11945 TYPE A | 11946 TYPE B | 11947 TYPE C | 11948 MAIDA ROLLER | 11949 MAIDA ROLLER DISC |
|---|---|---|---|---|---|---|---|---|
| Moisture | 9.0 | 11.15 | 12.15 | 9.0 | 9.1 | 9.50 | 9.10 | 9.70 |
| Ash: | 1.078 | 0.901 | 0.795 | 0.964 | 0.933 | 0.946 | 0.741 | 0.636 |
| Protein: | 10.11 | 10.16 | 10.28 | 10.40 | 10.12 | 10.55 | 9.18 | 10.10 |
| Farinograph | | | | | | | | |
| Absorption: | 76.3 | 64.0 | 64.6 | 66.9 | 67.6 | 68.8 | 69.8 | 69.5 |
| Arrival: | 2.0 | 1.5 | 1.5 | 1.5 | 1.5 | 1.5 | 1.5 | 2.0 |
| Peak: | 2.5 | 2.5 | 2.5 | 2.5 | 2.5 | 2.5 | 3.0 | 3.0 |
| Departure: | 3.5 | 3.5 | 3.5 | 4.0 | 3.5 | 3.5 | 4.0 | 4.0 |
| Stability: | 1.5 | 2.0 | 2.0 | 2.5 | 2.0 | 2.0 | 2.5 | 2.0 |
| MTI: | 120 | 125 | 125 | 100 | 95 | 115 | 100 | 95 |
| FN: | 592 | 471 | 552 | 596 | 567 | 536 | 630 | 503 |
| Alpine | | | | | | | | |
| on 100: | 13.0 | 27.4 | 27.4 | 0.6 | 0.5 | 1.4 | 0.2 | 0.3 |
| on 200: | 42.2 | 51.8 | 58.3 | 24.0 | 23.6 | 28.8 | 24.8 | 18.9 |
| on 325: | 65.9 | 71.6 | 77.0 | 51.6 | 55.8 | 60.8 | 63.4 | 61.8 |
| on 400: | 88.7 | 78.9 | 83.0 | 63.8 | 66.8 | 71.5 | 73.6 | 76.4 |
| Color (Dry) | | | | | | | | |
| L*: | 88.3 | 88.1 | 89.1 | 89.6 | 90.2 | 89.9 | 91.0 | 92.2 |
| a*: | 0.4 | 0.4 | 0.2 | 0.40 | 0.3 | 0.4 | 0.0 | −0.2 |
| b*: | 12.4 | 12.9 | 12.4 | 11.4 | 11.1 | 11.4 | 10.0 | 9.6 |
| Starch Damage: | 15.1 | 4.9 | 5.8 | 6.7 | 7.3 | 8.6 | 9.6 | 10.0 |
| Wet Gluten: | 17.97 | 29.1 | 26.4 | 25.1 | 22.2 | 23.9 | 21.1 | 21.1 |
| Gluten Index: | 0.38 | 0.15 | 0.15 | 0.07 | 0.10 | 0.06 | 0.33 | 0.40 |

Gold Seal Atta is a commercially produced atta flour in India made by a stone grinding method, as can be seen the Gold Seal Atta has sufficient starch damage. The remaining atta flours, however, had insufficient starch damage. These seven (7) different milling process were determined to be unacceptable.

Example 4

Milling trials to develop a suitable atta flour were next conducted at the ConAgra Milling Research facility in Omaha, Nebr.

The first trial involved pin milling 4000 lb. of patent flour at a rate of 2000 lbs./hour, that had 7.3% starch damage prior to pin milling the flour. Patent flour is also known as white flour and has 0.5% by weight ash. The patent flour was produced commercially at the ConAgra Flour Milling Company's Omaha B flour mill and then passed through an Alpine pin mill to reduce the particle size, so that 48% of the flour particles pass through a U.S. mesh 400 screen. Passage through the Alpine pin mill increased starch damage in the patent flour to 9.4%. Pin milling was considered unacceptable because there was insufficient starch damage, in particular there was not enough shear.

Example 5

Next, 1000 lb. of patent flour having 10.5% protein was heated to a temperature of 390° F. for 120 seconds in an APV dryer. Two (2) kg of the heat treated flour was passed once through an Allis Chalmers smooth roll mill with a gap setting of 0.01 mm, with the individual rolls which formed the smooth roll set to rotate at a speed 250 rpms and 500 rpms respectively. The flour produced had an amount of starch damage equal to about 9.0%. This process was unacceptable as there was insufficient starch damage and the heat treating step was not economical.

Example 6

An amount of Platt wheat, which is hard red winter wheat, was ground by a mill to an ultrafine grade whole wheat flour at the Con Agra Flour Milling Company's Alton flour mill located in Alton, Illinois. The ultrafine grinding produced a flour having approximately 45% of the particles pass through a 400 mesh screen and 100% of the particles pass through a 100 mesh screen. The mesh screens are U.S. mesh. The ultrafine grinding produced a flour that had 7.5% starch damage. The ultrafine grinding process did not cause enough shear for increased starch damage and as such was unacceptable.

Example 7

An amount of HRS and Durum wheat were mixed together in a 9:1 by weight ratio mixture, wherein the HRS wheat was equal to 9 parts by weight and the Durum wheat was equal to 1 part by weight. The wheat mixture was milled in a Buhler Laboratory pneumatic mill set to produce flour having an amount of ash equal 0.57% by weight of the flour. The mill was comprised of three break rolls and three reduction rolls, with a plan sifter under each roll. The HRS and Durum wheat were combined to equal a total amount of wheat equal to 2 Kg. The coarse bran was discarded, but the short was ground in a Laboratory Wiley mill and added to the combined break and reduction flours. The mixed flour was then passed through the smooth rolls of Allis Chalmer smooth roll twice. The smooth roll was comprised of two cylindrical individual smooth rolls, with one roll rotating at a speed of about 250 rpms and the other roll rotating at a speed of about 500 rpms. The resulting atta flour had starch damage equal to about 12.6%. This level of starch damage was encouraging as the level of starch damage increased from 5% in Example 1, where the flour was passed through the smooth mill once, to 12.6% in the present Example.

Example 8

An amount of HRW wheat equal to two (2) kilograms was tempered to 16% moisture by weight of the wheat by adding 120 cc of water to the wheat, with the wheat and water mixed together in a mixer for 15 minutes. The tempered wheat was then placed in a laboratory freezer overnight and frozen. The frozen wheat was then removed from the freezer and cracked in a Laboratory Wiley mill. After cracking the wheat in the Wiley mill it was passed twice through the smooth roll of an Allis Chalmers mill. The smooth roll was comprised of two individual smooth rolls, with one roll rotating at a speed of about 250 rpms and the other roll rotating at a speed of about 500 rpms. It was found that the atta flour produced had starch damage equal to about 21.0%. This high starch damage resulted from disruption caused by ice crystal pressure on starch granules in the wheat, as well as, the shear of grinding. This method was considered unacceptable because it is not presently commercially feasible.

Example 9

An amount of hard red winter wheat (HRW) equal to 1000 g was tempered to 14% moisture by adding 47 cc of water to the wheat, the wheat and water mixture was then mixed in a mixer for 15 minutes. The tempered HRW wheat was then dried overnight in a forced air oven, at a temperature of 95° C. Following drying, the wheat was cracked in Allis Chalmers corrugated roll and then further ground in an Allis Chalmers smooth roll by passing it twice through the smooth roll. The smooth roll was comprised of two individual cylindrical smooth rolls, with one roll rotating at a speed of about 250 rpms and the other roll rotating at a speed of about 500 rpms. The atta flour had an amount of starch damage equal to about 17.8%. While sufficient starch damage was achieved, this method was believed to be unsuitable because of the required long drying time, overnight. It was determined that the starch damage is due to shear of the smooth roll rather than drying.

Example 10

An amount of HRW wheat equal to two (2) Kg and having an amount of protein equal to 11% was milled by passing it through a corrugated roll once and a smooth roll twice, the same as in Example 9. After passage through the smooth roll, the flour was sifted on the 20 mesh screen of a laboratory sifter which was a Great Western Table Top sample sifter. All the bran on top of the 20 mesh screen was further ground in the smooth roll and added to the flour to make an atta flour. It was found that the starch damage in the flour was equal to about 15.9%. The ash content of the flour was over 1.6% by weight of the flour, as all of the ground bran was added to the flour. The chapati made from the atta flour was too dark, so that the atta flour was determined to be unacceptable. However, the amount of starch damage was desirable.

Example 11

An amount of HRW wheat equal to two (2) Kg and having 11.3% protein was milled by first cracking the wheat in a first break roll made by Allis Chalmers. The wheat was cracked successively the same as in Example 1, with gap settings set at 8, 4, and 1 to gradually reduce the particle size. The wheat was then ground by passing it through a sizing roll. Finally, the ground wheat was passed through a smooth roll at a speed differential of 400:200, so that one individual cylindrical roll rotated at 400 rpms and the other individual cylindrical roll at 200 rpms. After passage through the reduction roll, the flour was sifted through a 40 mesh screen in a laboratory sifter, which was a Great Western Table Top sample sifter. The bran was reground in the smooth roll of the mill and added to the flour. The flour had starch damage equal to about 11.3%. The flour produced was considered unacceptable because there was insufficient starch damage. It was determined that successive particle size reduction and sifting produced an insufficient amount of starch damage due to less shear. Regrinding of the product increased the starch damage.

Example 12

An amount of F mix wheat (HRW) equal to two (2) Kg and having an amount protein equal to about 11.4% by weight of the wheat was milled by passing the wheat through a corrugated roll manufactured by Allis Chalmers. The corrugated roll was comprised of two individual cylindrical rolls, with one roll rotating at a speed equal to about 250 rpms and the other roll rotating at a speed equal to about 500 rpms. The gap setting on the Allis Chalmers corrugated roll was equal to 0.075 mm. The wheat was then passed twice through an Allis Chalmers smooth roll reduction roll set at the closest gap setting available 0.02 mm and the same speed differential as the corrugated roll. The product was sifted through a 40 mesh screen in a laboratory sifter, which was a Great Western Table Top sample sifter. The bran on top of the screen was ground to reduce the particle size and sifted. The fines were added to the flour to bring the ash content to about 1.1%. The flour produced had an amount of starch damage equal to 14.0%. The atta flour produced was considered acceptable.

The primary differences between the method of the present Example and the method of Example 11, was that the present method involved successive grinding at a close gap setting. Comparatively, Example 11 involved successive grinding at a gradually smaller gap settings.

Example 13

A flour was prepared the same as in Example 12 except the flour was passed through the smooth roll three times. The resulting flour produced had an amount of starch damage equal to 17.9%. The flour produced was considered acceptable. This demonstrated that increased shear and repeated grinding resulted in increased starch damage.

Example 14

A different class of wheat, hard white wheat (HWW) was milled by passing it through the corrugated roll having an open setting the same as in Example 12. The wheat was passed through the smooth roll twice the same as in Example 12. The resulting flour had an amount of starch damage equal to 16.0%. The chapati formed from the atta flour had good texture and good color. This demonstrated that different types of wheat could be used to produce the atta flour.

Example 15

An amount of soft white wheat (SWW) equal to two (2) Kg was milled the same as in Example 12. It should be noted that flour from SWW wheat typically has from about 3% to 5% starch damage. The resulting atta flour had an amount of starch damage equal to 12.9%. The dough was slightly sticky and the chapati formed from the atta flour was good, especially in color.

Example 16

ConAgra atta flour was compared with a commercial atta flour made by Pillsbury India. The Pillsbury flour is produced by a stone grinding method. The ConAgra flour was produced the same as disclosed in Example 12, except that the flour was made from 5 kg of Indian white wheat, which is a semi-hard wheat. As can be seen from Example 12, the wheat was passed through a corrugated roll followed by passage through a smooth roll twice. The results were as follows:

Physical and Chemical Analysis of two Atta flours

| Parameter | Pillsbury Atta | ConAgra Atta |
|---|---|---|
| Moisture % | 8.82 | 9.57 |
| Ash % | 1.161 | 1.185 |
| Protein % | 10.54 | 9.32 |
| Farinograph Absorption % | 74.1 | 78.1 |
| Farinograph Arrival time | 3 min. | 3 min. |
| Farinograph Peak time | 4.5 min. | 4 min. |
| Farinograph Departure time | 6 min. | 4.5 min. |
| Farinograph Stability | 3 min. | 1.5 min. |
| Farinograph Mixing Tolerance Index | 90 BU | 80 BU |
| Falling # | 572 seconds | 507 seconds |
| Color L* Dry flour | 89.1 | 88.7 |
| Color A* Dry flour | 0.6 | 0 |
| Color B* Dry flour | 12 | 12.2 |
| Starch Damage % | 13.4 | 17.9 |
| Wet Gluten % | 37.23 | 35.21 |
| Gluten Index. | 0.75 | 0.88 |
| Mixograph Peak time | 2.3 min. | 2.1 min. |
| Mixograph Tolerance | 10.5 min. | 8.5 min. |
| Polyphenol Oxidase (PPO) | 493 nanomoles O2/gm/min | 215 nanomoles O2/gm/min |
| Particle size % on U.S. 100 mesh sieve | 10 | 30 |
| Particle size % on U.S. 200 mesh sieve | 46.5 | 64.6 |
| Particle size % on U.S. 325 mesh sieve | 73.6 | 83.9 |
| Particle size % on U.S. 400 mesh sieve | 87.2 | 88.6 |

The moisture, ash, and protein data related to the amount of each constituent found by weight in each of the atta flours. The percent moisture in the atta flour was determined by the American Association of Cereal Chemists (AACC) method 44-16. The percent ash in the atta flour was determined by AACC method 8-01. The percent protein in the atta flour was determined by AACC method 46-30. The AACC method # used to determine the amount of moisture, ash, and protein and used in many of the tests discussed below refers to a standard method published by the American Association of Cereal Chemists (AACC). The AACC is an international organization that reviews analytical research and publishes standard methods.

Farinograph related to measurements taken by a farinograph, which was made by C.W. Brabender Co. model 810101, located South Hackensack, N.J. A farinograph is commonly used to test dough and flour mixing characteristics which include water absorption, optimum mixing time, and resistance of dough to breakdown. The dough tested by the farinograph was prepared according to AACC Method 54-21.

Falling # relates to an indirect measurement of alpha amylase activity in flour. The method is based on the ability of the alpha amylase to degrade starch gels, with the falling # test procedure based on AACC procedure 56-81B. The higher falling numbers, above 300, indicate low amylase activity and sound wheat, the low falling number, below 250, indicate high amylase activity and sprout damaged wheat. Amylase activity relates to enzymes which will degrade starch into sugar.

Color L, "a", "b" values, more specifically, L Dry, "a" Dry, and "b" Dry relate to the color of the flour. These measurements were made using a colorimeter, product colorgard systems 1000, sold by Pacific Scientific located in Silver Springs, Md. The L Dry value relates to lightness (100) to darkness (0), so that the lighter the material the higher the number. The "a" Dry value indicates greenness (−ve) to redness (+ve) and the "b" Dry value indicates blueness (−ve) to yellowness (+ve).

Starch damage was measured by using a megazyme starch damage assay procedure sold by Megazyme International Ireland, Ltd., Ireland, the megazyme procedure was performed under AACC Method 76-31 . The test related to the physical damage to starch granules in the atta flour due to milling. The starch damage relates to flour quality, as it affects water absorption and mixing properties of dough made from flour. High starch damage is preferred in atta flour as it improves water absorption and puffing characteristics.

Wet gluten is a visco-elastic substance obtained by mixing an amount of wheat flour and with an amount of water. A glutomatic apparatus made by Perten, model # Glutomatic 2200, located in Huddiag, Sweden, was used in the mechanical determination of the wet gluten content. The procedure used to test the gluten was under AACC 38-12. To perform the test a flour-water dough was prepared by adding a small quantity of 2% NaCl solution to the flour and washing the starch to obtain a gluten ball. Residual water was removed by centrifugation, with the wet gluten percentage determined by weighing the centrifuged gluten ball. The gluten index is the percentage of strong gluten that is retained inside the sieve to the total gluten. This is a measure of gluten strength.

Gluten index is a method for measuring wet gluten characteristics, with the gluten index determined the same as the wet gluten. After obtaining wet gluten from the Glutomatic, it is centrifuged against a special sieve for one minute and weighed. The special sieve permits the collection of both parts of the gluten; the part that passed through the sieve and the part that was retained by the sieve. The percent of gluten retained by the sieve is defined as the Gluten Index. Low values represent weak flour protein and high values represent strong flour protein.

Mixo relates to data assembled using a mixograph. The mixograph, made by National Manufacturing, provides information regarding optimum development time, stability, and other characteristics of dough. The longer mixing time indicates the stronger flour and the longer tolerance time indicates an increased tolerance for overmixing.

PPO relates to the amount of polyphenol oxidase found in the flour. Polyphenol oxidase is an enzyme responsible for enzymatic browning reactions in whole wheat flours. It is preferred to have a low PPO percentage as found in the ConAgra atta listed above. The PPO is determined using the method disclosed by D. W. Hatcher and J. E. Kruger in 1993, in an article entitled "Distributions of Polyphenol Oxidase in Flour Millstreams of Canadian Common Wheat Classes Milled to Three Extraction Rates", in Cereal Chem., 70:51–55.

Particle size relates to the granulation of flour as measured by an Alpine Jet Sieve and the percent flour remaining on each sieve (U.S. mesh sizes 100, 200, 325, and 400). Coarse flour was indicated by the high percentage of flour on the smaller mesh sizes, for example 100.

From the above tests it was found that flour produced according to the present method was very similar to the flour produced according to the commercial stone grinding method. It was determined that the two flours were essentially the same except that the two flours had a different granulation, which was determined by the Alpine. Importantly, it was determined that a flour could be produced under the present method which resembled a flour produced according to a stone grinding method.

Example 17

Two bread doughs were formed, one from Pillsbury atta flour and one from ConAgra atta flour, by adding roughly 100 grams each of the flours to two (2) separate vessels. Water in an amount equal to 68 grams per 100 grams of flour was then added to the flour until the hydration was good and the dough was then kneaded manually. The dough was thoroughly hand kneaded, compressed between the palm and kept for 10–20 minutes in a closed vessel prior to use.

The hand compressed doughs were then drawn out, shaped into small balls of roughly 1.5 inch diameters and rolled out into round, flat plates. The two (2) sets of doughs were then converted into chapatis or rotis.

To form the chapatis, the flat dough was heated on a hat tawa, which is a hot plate, under a controlled flame. After about a minute, the dough was reversed. After another minute, a little amount of "ghee", which is essentially butter, was added and spread over the dough, the dough was then reversed and the process continued so as to shallow roast the dough in "ghee" until the chapatis were ready. The manufactured chapatis were then kept covered in a vessel for consumption for approximately half an hour.

The rotis were formed by heating the flat dough on a hot tawa. After about a minute, the flat dough was reversed. Further to this, the material was heated in a direct flame and reversed until the rotis puffed. The prepared rotis were drawn out, spread with a small amount of ghee and kept closed in a vessel until further use for consumption almost half an hour later.

After the formation of the breads they were then analyzed in a side-by-side comparison with 1 being highly unacceptable and 10 being highly acceptable.

| | Pillsbury Atta | | ConAgra Atta | |
|---|---|---|---|---|
| | Chapati | Roti | Chapati | Roti |
| Appearance | 8 | 8.5 | 8.5 | 9 |
| Flavor | 9 | 8.5 | 9 | 9 |
| Puffing | 9 | 9 | 9 | 9 |
| Softness | 9 | 9 | 8.5 | 7.5 |
| Overall | 9 | 8.5 | 8.5 | 8 |

It was concluded that the two atta flours produced breads having very similar results.

After conducting the following experiments it was concluded that high starch damage could be achieved by repeated and over grinding of the wheat in a roller mill, meaning multiple passes through the roller mill. It was further concluded that no tempering of the wheat prior to milling was required. The preferred process involved cracking the wheat in a corrugated roll to reduce particle size, followed by passing the cracked wheat stock through two to three successive smooth rolls at the closest setting, at a low feed rate, and a speed differential of 2:1 to 3: 1, with no sifting between the successive passes required. The flour was then preferably sifted through a U.S. mesh 40 screen, with the over being reground and sifted, and the fines added to the flour to bring the ash content to from about 1. 1% to about 1.3%.

Example 18

| Brand | Milling Procedure | Moisture | Ash 14% MB | Protein 14% MB | Starch Damage |
|---|---|---|---|---|---|
| Gold Seal | Stone | 9.0 | 1.078 | 10.1 | 15.1 |
| Annaurna | Stone | 8.9 | 1.123 | 10.6 | 14.9 |
| Chakki | Roller | 8.7 | 1.219 | 11.2 | 10.0 |
| Special | Roller | 12.5 | 0.487 | 9.8 | 6.6 |
| Resultant | Roller | 11.4 | 0.838 | 10.7 | 7.5 |
| Surgarana | Roller | 12.6 | 0.555 | 9.7 | 7.4 |
| S. Special | Roller | 12.0 | 0.523 | 9.8 | 8.1 |
| Captain Cook | Stone | 8.3 | 1.267 | 10.7 | 15.1 |
| Shakki Bhog | Roller | 11.9 | 1.219 | 10.5 | 11.5 |
| Truptha | Roller | 11.9 | 1.025 | 10.5 | 6.6 |
| Golden Temple | Roller | 11.0 | 1.19 | 11.3 | 10.5 |
| SWAD | Roller | 12.1 | 1.262 | 11.5 | 9.3 |

The above table shows the amount of ash and starch damage in various commercial flours sold in India. The results importantly show that when a roller mill is used sufficient starch damage is not achieved. Even when the amount of ash is sufficient the starch damage is insufficient. What this demonstrates is that commercial methods for producing atta flour through a roller mill are presently unknown.

Thus, there has been shown and described novel method for producing an atta flour which fulfills all of the objects and advantages sought therefor. It will be apparent to those skilled in the art, however, that many changes, variations, modifications, and other uses and applications for the subject method is possible, and also changes, variations, modifications, and other uses and applications which do not depart from the spirit and scope of the invention are deemed to be covered by the invention which is limited only by the claims which follow.

What is claimed is:

1. A method for producing an atta flour, wherein said atta flour contains between about 13% and about 17% damaged starch and at least 1% ash, with said method consisting essentially of:

a) first, passing an amount of untreated wheat through a corrugated roll assembly so as to crack said wheat's kernel and form an amount of cracked wheat;

b) second passing said cracked wheat through a smooth roll assembly to form an amount of flour;

c) followed by passing said flour through a smooth roll assembly to form twice ground flour;

d) passing said twice ground flour through a smooth roll assembly to form a thrice ground flour; and, e) sifting said thrice ground flour through at least a U.S. mesh 40 screen to form said atta flour.

2. The method of claim 1 wherein said smooth roll assembly in steps b, c, and d is comprised of a pair of separate cylindrical rolls with one roll rotating at a speed of ranging between about 200 rpms and 250 rpms and the other roll rotating at a speed ranging between about 500 rpms and about 600 rpms.

3. The method of claim 1 wherein said wheat is selected from the group consisting of Indian wheat, plat wheat, HRS wheat, durum wheat, HRW wheat, SWW wheat, HWW wheat, and SRW wheat.

4. The method of claim 2, wherein one of said rolls rotates at a speed of 250 rpms and the other roll rotates at a speed of 500 rpms.

5. The method of claim 1 wherein said method includes adding an amount of fines to said atta flour.

6. The method of claim 1 wherein said smooth roll assembly in steps b, c, and d has a gap setting of at least 0.01 mm.

7. The method of claim 1 wherein said corrugated roll is comprised of a pair of corrugated rolls with one roll rotating at a speed of ranging between about 200 rpms and 250 rpms and the other roll rotating at a speed ranging between about 500 rpms and about 600 rpms.

8. A method for producing an atta flour, wherein said atta flour contains between about 13% and about 17% damaged starch, and at least 1% ash with said method consisting of:

a) first, cracking an amount of untreated wheat to form an amount of cracked wheat;

b) second, passing said cracked wheat through a smooth roll assembly at least twice to form an amount of ground flour; and, c) sifting said ground flour through a U.S. mesh 40 screen to form said atta flour.

* * * * *